US011193655B2

(12) United States Patent
Millson et al.

(10) Patent No.: US 11,193,655 B2
(45) Date of Patent: Dec. 7, 2021

(54) LIGHTING APPARATUS AND RELATED METHODS

(71) Applicant: Enlightened Audio Inc., Vancouver (CA)

(72) Inventors: Richard Blair Millson, Vancouver (CA); Alan Toyonobu Ima, Maple Ridge (CA); Adam Stefanski, Vancouver (CA)

(73) Assignee: Enlightened Audio Inc., Vancouver (CA)

( * ) Notice: Subject to any disclaimer, the term of this patent is extended or adjusted under 35 U.S.C. 154(b) by 44 days.

(21) Appl. No.: 16/821,324

(22) Filed: Mar. 17, 2020

(65) Prior Publication Data

US 2020/0217484 A1 Jul. 9, 2020

Related U.S. Application Data

(63) Continuation-in-part of application No. 16/146,763, filed on Sep. 28, 2018, now abandoned.

(60) Provisional application No. 62/572,640, filed on Oct. 16, 2017.

(51) Int. Cl.

| | |
|---|---|
| ***F21V 15/01*** | (2006.01) |
| ***F21V 21/096*** | (2006.01) |
| ***F21V 29/77*** | (2015.01) |
| ***F21V 29/76*** | (2015.01) |
| ***F21Y 115/10*** | (2016.01) |
| ***H04R 1/02*** | (2006.01) |

(52) U.S. Cl.

CPC ..... *F21V 15/01* (2013.01); *F21V 21/096* (2013.01); *F21V 29/763* (2015.01); *F21V 29/773* (2015.01); *H04R 1/026* (2013.01); *H04R 1/028* (2013.01); *F21Y 2115/10* (2016.08)

(58) Field of Classification Search

None

See application file for complete search history.

(56) References Cited

U.S. PATENT DOCUMENTS

| | | | | | |
|---|---|---|---|---|---|
| 1,272,843 | A ‡ | 7/1918 | Pape | F21V 33/0056 | 362/86 |
| 2,083,753 | A ‡ | 6/1937 | Turner | F21V 33/00 | 181/15 |
| 2,501,968 | A ‡ | 3/1950 | Sassin | H05K 11/00 | 362/25 |
| 2,924,661 | A ‡ | 2/1960 | Messeas, Jr. | F21V 33/0056 | 381/38 |
| 3,023,830 | A ‡ | 3/1962 | Hammes | H04R 1/028 | 181/14 |
| 3,194,952 | A ‡ | 7/1965 | Wells | H04R 1/028 | 362/86 |
| 4,214,298 | A ‡ | 7/1980 | Propst | F21V 33/0056 | 362/25 |

(Continued)

*Primary Examiner* — Ashok Patel

(74) *Attorney, Agent, or Firm* — Kilpatrick Townsend & Stockton LLP

(57) ABSTRACT

A method is disclosed of modifying a lighting apparatus including a housing. The method involves detachably attaching at least one speaker to the housing when the at least one speaker is in the housing. At least one light source is detachably attachable to the housing independently from attachment of the at least one speaker to the housing. Lighting apparatuses are also disclosed.

20 Claims, 7 Drawing Sheets

(56) References Cited

U.S. PATENT DOCUMENTS 4,280,019 A ‡ 7/1981 Propst ..... H04R 1/028 181/15
4,433,363 A ‡ 2/1984 Weber ..... G08B 3/10 362/14
4,528,620 A ‡ 7/1985 Weber ..... F21S 8/065 362/14
4,776,018 A ‡ 10/1988 Cordier ..... H04B 1/08 381/33
5,477,205 A ‡ 12/1995 Burns ..... G08B 7/06 340/32
5,828,765 A ‡ 10/1998 Gable ..... H04R 1/028 381/38
5,980,057 A ‡ 11/1999 Christie ..... F21V 33/0056 362/23
5,995,634 A ‡ 11/1999 Zwolski ..... H04R 1/028 181/15
6,630,800 B2 ‡ 10/2003 Weng ..... G08C 17/00 315/29
6,748,096 B2 ‡ 6/2004 Chuang ..... H04R 1/026 381/39
7,455,435 B2 ‡ 11/2008 Mathews ..... H05B 47/185 362/44
7,535,341 B2 ‡ 5/2009 Haase ..... G08B 7/06 340/32
2003/0127990 A1 ‡ 7/2003 Weng ..... G08C 17/00 315/29
2005/0128743 A1 ‡ 6/2005 Chuey ..... H05B 47/12 362/23
2005/0185392 A1 ‡ 8/2005 Walter ..... B05B 17/0646 362/96
2007/0064433 A1 ‡ 3/2007 Wright ..... F21V 33/0056 362/36
2007/0223723 A1 ‡ 9/2007 Haase ..... H04R 1/028 381/77
2008/0143495 A1 ‡ 6/2008 Haase ..... F21K 9/00 340/32
2008/0298045 A1 ‡ 12/2008 Wright ..... F21V 33/0056 362/86
2009/0207607 A1 8/2009 Haase et al.
2011/0064258 A1 * 3/2011 Aggarwal ..... H04S 7/302 381/394
2012/0230499 A1 9/2012 Suzuki et al.
2012/0274767 A1 11/2012 Hornback
2014/0376747 A1 12/2014 Mullet et al.
2018/0220506 A1 8/2018 Sadwick

* cited by examiner
‡ imported from a related application

LIGHTING APPARATUS AND RELATED METHODS

CROSS REFERENCE TO RELATED APPLICATIONS

This application is a continuation-in-part of application Ser. No. 16/146,763 filed Sep. 28, 2018, which claims the benefit of Provisional Application Ser. No. 62/572,640 filed Oct. 16, 2017.

FIELD

This disclosure relates to lighting apparatuses and at least one speaker.

RELATED ART

Buildings or other structures may include one or more lighting fixtures, such as one or more can-style lighting fixtures where the lighting fixture may be recessed into a wall or ceiling, for example, but such lighting fixtures may not include an intercom or speakers.

SUMMARY

According to at least one embodiment, there is disclosed a speaker light fixture that may integrate a light and a speaker into the same recessed lighting fixture. The illumination may be provided from efficient light-emitting diode (LED) elements, and sound may be provided from separate but integrated speaker components. In some embodiments, the speaker portion may be easily added at any time and may function in a complete package that may be installed as a can light fixture, and heat from the LEDs may be conducted away from the light source.

According to at least one embodiment, there are disclosed improvements in a lighting fixture with an integrated speaker. According to at least one embodiment, there is disclosed a ceiling- or wall-mount fixture that may combine both lighting and sound in a single fixture. The fixture may be designed with LED lighting and may include a heatsink to conduct heat from the illumination element to an area on the top area of the fixture. One or more signals to the speaker may be with a wired or wireless connection. In some embodiments, the LED lighting portion and the speaker portion are able to be installed and activated separately and independently from one another, which may allow an LED lighting fixture to be upgraded at any time with the addition of the speaker component.

According to at least one embodiment, there is disclosed a speaker light fixture comprising: a light emitting diode illumination source on a first side of a speaker; said light emitting diode illumination source is thermally connected to a heat sink transfer shaft; said heat sink transfer shaft passes through a speaker cone voice coil and magnet structure for said speaker; said heat sink transfer shaft is thermally connected to a heat sink at a second side of said speaker, and said light emitting diode illumination source and said speaker are oriented to emit light and sound respectively from said first side of said speaker.

In some embodiments, said speaker is a midrange or a woofer.

In some embodiments, the speaker light fixture further includes at least one high frequency speaker arranged on front of said light emitting diode illumination source.

In some embodiments, the speaker light fixture further includes at least one microphone.

According to at least one embodiment, there is disclosed a light with a speaker for home or business installation. The lighting fixture may house the audio receiver/audio amplifier for the speaker, the lighting element and control driver for the lighting element. Keeping all of these elements in the same fixture may create a single package for installation. The light emitting diode (LED) may have a heat sink that may conduct heat from the LED to an area at the top of the fixture. Diverting the heat away from the LED may move the heat away from the speakers and may also open the lower area of the fixture for better acoustics. The heat sink may pass through a large diameter woofer that may move air for cooling of the heat sink and the LED lighting. The speaker may obtain an audio signal from a wired or wireless connection. A microphone may also be included for two-way communication.

According to at least one embodiment, there is disclosed a speaker light fixture comprising: a light emitting diode illumination source on a first side of a speaker; said light emitting diode illumination source is thermally connected to a heatsink transfer shaft; said heatsink transfer shaft passes through a speaker cone voice coil and a magnet of said speaker; said heatsink transfer shaft is thermally connected to a heatsink cap at a second side of said speaker, and said light emitting diode illumination source and said speaker are oriented to emit light and sound respectively from said first side of said speaker.

In some embodiments, said speaker is a midrange or a woofer.

In some embodiments, said heat sink transfer shaft extends concentrically through said magnet structure of said midrange or said woofer.

In some embodiments, said midrange or said woofer is configured to increase airflow past said heat sink transfer shaft.

In some embodiments, the speaker light fixture further includes at least one mid-high frequency speaker arranged in front of or co-planar with said light emitting diode illumination source.

In some embodiments, at least one said mid-high frequency speaker is located outside of a reflective cone.

In some embodiments, the speaker light fixture further includes at least one microphone.

In some embodiments, at least one said microphone is located in an outer ring.

In some embodiments, said heatsink cap is thermally connected to an outer frame body.

In some embodiments, said outer frame body is cylindrical and is threaded onto said heatsink cap.

In some embodiments, said outer fame body connects to an outer ring.

In some embodiments, said outer ring includes a plurality of magnets.

In some embodiments, said magnets are configured to retain a cosmetic facia or grill.

In some embodiments, said light emitting diode source is located within a reflective cone.

In some embodiments, the speaker light fixture further includes a speaker enclosure that is located between said heatsink cap and said outer ring.

In some embodiments, said speaker light fixture further includes a mounting box.

In some embodiments, said mounting box is configured to mount onto studs or joists.

In some embodiments, said mounting box includes an electrical junction box for termination and cross connection of electrical power.

In some embodiments, said mounting box includes a power converter or control driver for said light emitting diode illumination source.

In some embodiments, said mounting box includes an audio streamer/amplifier/wireless transceiver unit that is configured to receive audio and control signals by a wired or wireless connection.

In some embodiments, said audio streamer/amplifier/wireless transceiver unit controls signals to said speakers.

According to at least one embodiment, there is disclosed a light with a speaker for home or business installation. The lighting fixture may house the audio receiver/audio amplifier for the speaker, the lighting element and control driver for the lighting element. In some embodiments, the audio source and or amplifier can be external. In some embodiments, the speaker/crossover/amplifier/audio streamer can be added at any time, which may allow installation flexibility. Keeping all of these elements in the same fixture may create a single package for installation. The light emitting diode (LED) may have a heatsink that may conduct heat from the LED to an area at the top of the fixture. Diverting the heat away from the LED may move the heat away from the speakers and may also open the lower area of the fixture for better acoustics. The heatsink may pass through a large diameter woofer that may move air for cooling of the heatsink and the LED lighting. The audio receiver/audio amplifier for the speaker may obtain an audio signal from a wired or wireless connection. A microphone may also be included for two-way communication.

In some embodiments, a speaker light fixture may provide a lighting element that is configured to operate in a can lighting fixture. The can lighting fixture may house both the speaker and the audio receiver/amplifier for the speaker, as well as the lighting element and the control driver for the lighting element. Keeping all of these elements in the same fixture may create a single package for installation. The housing may be installed with the initial installation onto the studs or joists of new construction or remodeling, and the speaker and the audio receiver/audio amplifier for the speaker, as well as the lighting element and the control driver for the lighting element may be installed at a later time.

In some embodiments, the lighting element may be a light emitting diode (LED), and the LED may be connected to a heatsink that may divert heat from the LED to an area at the top of the fixture. Diverting the heat away from the LED may move the heat away from the speakers and may also open the lower area of the fixture for better acoustics.

In some embodiments, the heatsink for the lighting element may transfer heat through the center of a speaker. In some embodiments, the speaker may be a large-diameter woofer where the woofer moves a larger volume of air and the open center of the woofer allows free movement of the woofer and this movement of the woofer furthers air movement for cooling of the heatsink and the LED lighting.

In some embodiments, one or more signals to the sound producing elements may be provided as a wired connection or as a wireless connection. The wireless connection may also include a repeater that may increase the distance that the wireless signal may be sent and/or received.

According to at least one embodiment, there is disclosed a method of modifying a lighting apparatus comprising a housing, the method comprising detachably attaching at least one speaker to the housing when the at least one speaker is in the housing, wherein at least one light source is detachably attachable to the housing independently from attachment of the at least one speaker to the housing.

In some embodiments, when the at least one light source and the at least one speaker are detachably attached to the housing, the at least one light source is connectable to a power source independent of a power source of the at least one speaker.

In some embodiments, the at least one light source is detachably attachable to the housing by, at least, positioning a light-source attachment body through at least a through-opening of a magnet of a speaker of the at least one speaker, the light-source attachment body attached to the at least one light source.

In some embodiments, the light-source attachment body comprises a heat conductor thermally connected to the at least one light source.

In some embodiments: when the at least one light source and the at least one speaker are detachably attached to the housing, the at least one light source is on a first side of the speaker, the at least one light source is oriented to emit light from the first side of the speaker, and the at least one speaker is oriented to emit sound from the first side of the speaker; and the at least one light source is detachably attachable to the housing by, at least, detachably attaching the heat conductor to a heatsink on a second side of the speaker opposite the first side of the speaker, the heatsink comprising a plurality of cooling fins.

In some embodiments: the housing is a cylindrical body; the at least one light source is light-emitting diode (LED) elements; the light-source attachment body is a heatsink transfer shaft; the heatsink is a heatsink cap on the housing; and the at least one light source is detachably attachable to the housing by, at least, positioning the heatsink transfer shaft through a speaker cone, a voice coil, and the magnet of the speaker.

In some embodiments, detachably attaching the at least one speaker to the housing comprises detachably attaching a speaker attachment body to the housing, the speaker attachment body movable relative to the speaker and to the housing.

In some embodiments, detachably attaching the speaker attachment body to the housing comprises threadedly attaching the speaker attachment body to the housing.

In some embodiments, detachably attaching the speaker attachment body to the housing comprises retaining a speaker support body in the housing and supporting the speaker.

In some embodiments, detachably attaching the at least one speaker to the housing comprises detachably attaching the at least one speaker to the housing when the housing is mounted in a ceiling or wall.

According to at least one embodiment, there is disclosed a lighting apparatus comprising: a housing; at least one speaker positionable in the housing and detachably attachable to the housing when positioned in the housing; and at least one light source detachably attachable to the housing independently from attachment of the at least one speaker to the housing when the at least one speaker is positioned in the housing.

In some embodiments, when the at least one light source and the at least one speaker are detachably attached to the housing, the at least one light source is connectable to a power source independent of a power source of the at least one speaker.

In some embodiments: a speaker of the at least one speaker comprises a magnet defining a through-opening between a first side of the speaker and a second side of the speaker opposite the first side of the speaker; and the apparatus further comprises a light-source attachment body attached to the at least one light source, the light-source attachment body positionable through at least the through-opening of the magnet and detachably attachable to the housing such that detachably attaching the light-source attachment body to the housing detachably attaches the at least one light source to the housing when the at least one speaker is positioned in the housing.

In some embodiments, the light-source attachment body comprises a heat conductor thermally connected to the at least one light source.

In some embodiments: when the at least one light source and the at least one speaker are detachably attached to the housing, the at least one light source is on the first side of the speaker, the at least one light source is oriented to emit light from the first side of the speaker, and the at least one speaker is oriented to emit sound from the first side of the speaker; the apparatus further comprises a heatsink comprising a plurality of cooling fins; and the light-source attachment body is positionable through at least the through-opening of the magnet and attachable to the heatsink such that detachably attaching the light-source attachment body to the heatsink detachably attaches the at least one light source to the housing when the at least one speaker is positioned in the housing.

In some embodiments: the housing is a cylindrical body; the at least one light source is light-emitting diode (LED) elements; the light-source attachment body is a heatsink transfer shaft; the heatsink is a heatsink cap on the housing; the speaker further comprises a speaker cone and a voice coil; and the heatsink transfer shaft is positionable through at least the speaker cone, the voice coil, and the through-opening of the magnet and attachable to the heatsink such that detachably attaching the heatsink transfer shaft to the heatsink detachably attaches the at least one light source to the housing when the at least one speaker is positioned in the housing.

In some embodiments, the apparatus further comprises a speaker attachment body movable relative to the speaker and to the housing and detachably attachable to the housing, and detachably attaching the speaker attachment body to the housing detachably attaches the at least one speaker to the housing when the at least one speaker is positioned in the housing.

In some embodiments, the speaker attachment body is threadedly attachable to the housing.

In some embodiments, the apparatus further comprises a speaker support body supporting the speaker, and detachably attaching the speaker attachment body to the housing detachably attaches the speaker support body in the housing.

According to at least one embodiment, there is disclosed a lighting apparatus comprising: a housing; at least one speaker positionable in the housing and comprising a means for detachably attaching the at least one speaker to the housing when the at least one speaker is positioned in the housing; and at least one light source comprising a means for detachably attaching the at least one light source to the housing independently from attachment of the at least one speaker to the housing when the at least one speaker is positioned in the housing.

Other aspects and features will become apparent to those ordinarily skilled in the art upon review of the following description of illustrative embodiments in conjunction with the accompanying figures.

DETAILED DESCRIPTION

Figure 1:
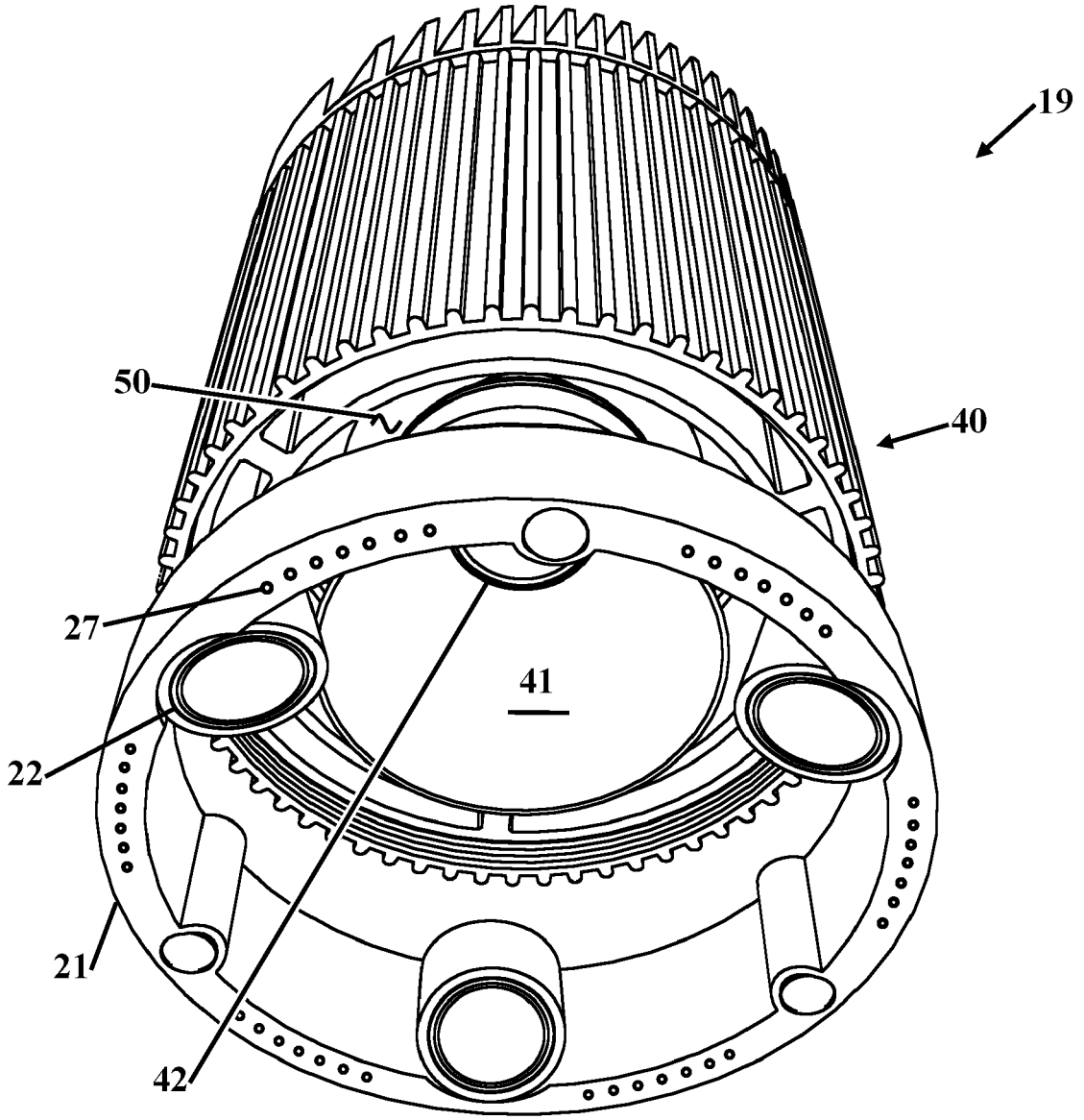
FIG. 1 shows a perspective view of a lighting apparatus according to one embodiment.

It will be readily understood that the components as generally described and illustrated in the drawings herein could be arranged and designed in a wide variety of different configurations. Thus, the following more detailed description of embodiments, as represented in the drawings, is not intended to limit the scope of the invention, but is merely representative of various embodiments of the invention.

FIG. 1 shows a perspective view of a lighting apparatus (which may be referred to as a speaker light fixture) 19 according to one embodiment. The lighting apparatus 19 is configured in a cylindrical shape to fit within a custom recessed can lighting fixture. However, alternative embodiments may differ and may, for example, have shapes other than cylindrical shapes. The speaker and lighting elements may project downward and outward from the underside of the cylindrical shape of the lighting apparatus 19.

The lighting apparatus 19 includes a light source (or a light or light-emitting source ("LES")) 42 on a light-source attachment body, such as a heatsink transfer shaft 43 in the embodiment shown. The light source 42 may include one or more light-emitting diodes ("LEDs") or one or more clusters of LEDs, for example. In some embodiments, LEDs may be easy to configure for different lighting applications, but LEDs generate heat, and the heat may have to be removed from near the LEDs, for example to extend the life of the LEDs. Also, as described below, in the embodiment shown, the lighting apparatus 19 may include one or more speakers or speaker elements, and moving the heat from the LEDs and away from the speaker elements may also reduce heat damage to the speakers and may further extend the life of the speakers.

In some embodiments, space within the lighting apparatus 19 may be limited due to the inclusion of multiple speaker elements, and the heat may be transferred through the body of the lighting apparatus 19 to external cooling fins in a cylindrical body (or housing) 40 of the lighting apparatus 19, in a top cap/heatsink 32 of the lighting apparatus 19, or in both. A reflector or diffuser cone 41 may focus or direct light from the light source 42. The heatsink from the light source 42 may be passed through a low frequency speaker, such as a woofer or mid-range speaker 50.

One or a plurality of higher frequency speakers 22 (or mid-tweeters or tweeters) may be arranged in the front of an outer ring 21. While this configuration shows three mid/high frequency speakers 22, more than three or less than three speakers 22 are contemplated based upon the desired sound quality or high frequency dispersion pattern. The overall length and diameter (or other dimension or shape) of the lighting apparatus 19 may be determined by a desired diameter (or other dimension or shape) of the lighting apparatus 19 and a wall stud or joist spacing and depth. One or more microphones 27 may be included in the outer speaker ring 21. While the microphones 27 are shown in the outer speaker ring 21, they can be located in other locations or can be on a separate ring.

Figure 2:
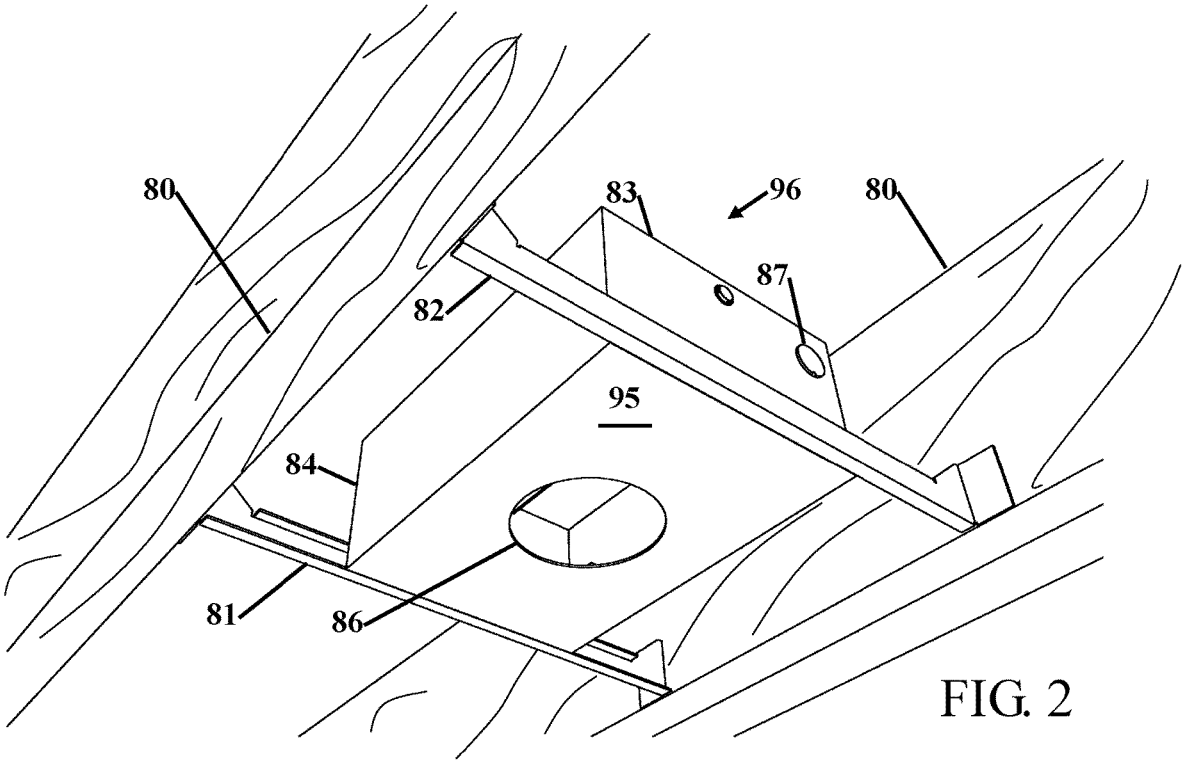
FIG. 2 shows a perspective view of a mounting box according to one embodiment as viewed from below.
Figure 3:
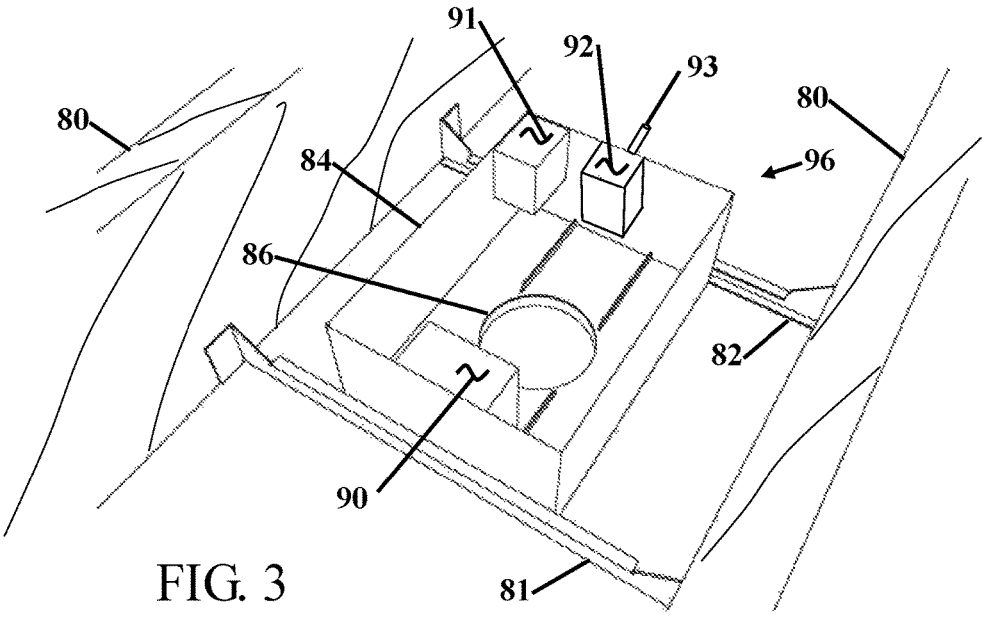
FIG. 3 shows a perspective view of the mounting box of FIG. 2 as viewed from above with the top of the enclosure removed for visibility of the internal components.

FIG. 2 shows a perspective view of mounting box 96 according to one embodiment as viewed from the ground, and FIG. 3 shows a perspective view of the mounting box 96 as viewed from above with the top removed to provide visibility of the internal components. The mounting box 96 may be installed in new or remodeling construction between studs or joists 80. Span brackets 81 and 82 may connect between the joists 80 to support the mounting box 96. While a standard mounting box may be used, in this embodiment the mounting box 96 houses internal connection features and junctions that are shown in FIG. 3.

In FIG. 3, the internal connections are for the external power connection box (or electrical power junction box) 91, and connections may enter the mounting box 96 through one or more electrical knock-outs 87. Such connections may provide power to the light source 42, power to a receiver and/or amplifier in an audio streamer/amplifier/wireless transceiver unit 92, or both. The electrical junction box 91 may provide termination and cross connection of electrical power, which may eliminate an additional source for heat generation within the lighting apparatus 19. A wireless receiver in the audio streamer/amplifier/wireless transceiver unit 92 can be included with an antenna 93 that can pass outside of the mounting box 96. In the embodiment shown, an LED driver module (or light-source driver module) 90 is shown within the mounting box 96 and may include a power converter that can convert current and voltage to drive the light source 42. However, in other embodiments, a power converter can be included in the external power connection box 91 to convert current and voltage to drive the light source 42.

In general, in embodiments such as those described herein, a power source for speakers may be independent from a power source for the light source 42, and a controller for speakers may be independent from controllers for the light source 42. Therefore, for example, the light source 42 may be turned on by turning on power for a power source (for example, an alternating current ("AC") power source of 120 volts) for the light source 42, the light source 42 may be turned off by turning off the power for the power source for the light source 42, and the light source 42 may be dimmed by reducing the power for the power source for the light source 42, but such turning on and off or dimming of the light source 42 may not necessarily affect any speakers because the speakers may have a power source (for example, a low-voltage source such as power over Ethernet ("PoE") or another low-voltage power source) independent of the power source of the light source 42. However, in other embodiments, a common power source may provide power to both the light source 42 and to one or more speakers.

Also, in embodiments such as those described herein, one or more speakers may be controlled by the audio streamer/amplifier/wireless transceiver unit 92 or by one or more other speaker controllers, which may be independent from any controller or controllers of the light source 42, and which may control volume, audio source, equalization, grouping with other zones, or other control parameters of speakers. However, in some embodiments, a common controller may control some or all control parameters of the light source 42 and of one or more speakers. Control signals to such a common controller may be encoded in power from a power source (such as AC power from an AC power source, for example) for the common controller or in other control signals to the common controller, for example. Nevertheless, embodiments such as those described herein may provide independent control of lighting and speakers.

The mounting box 96 may be formed from sheet metal with side walls 84, a mounting box front face 95 with an opening 86 for the light speaker, and a rear opening 83 that is optionally covered with a back plate (not shown in these figures). The mounting box 96 may be a self-contained enclosure that may provide electrical and audio connections, mounting for the lighting apparatus 19, and/or protection for the components. In some embodiments, the back of the speaker may be left open so that the mounting box 96 may serve as a speaker enclosure, which may enhance or improve performance of the speaker.

In FIG. 3, the audio streamer/amplifier/wireless transceiver unit 92 is shown within the side walls 84 of the mounting box 96, but alternative embodiments may differ. For example, in some embodiments, the streamer/amplifier/wireless transceiver unit 92 (or an alternative audio amplifier, audio source, or both) may be within or outside the cylindrical body 40, or within or outside the woofer speaker enclosure 35, or within or outside the mounting box 84, for example. More generally, of course, the mounting box 96 is an example only, and alternative embodiments may differ.

Further, in some embodiments, the cylindrical body (or housing) 40 can lighting fixture may house one or more speakers, an audio receiver/amplifier for the one or more speakers, the light source 42, and a control driver for the light source 42. Alternatively, in other embodiments, the audio receiver/amplifier for the one or more speakers may be outside the cylindrical body (or housing) 40 while the one or more speakers, the light source 42, and the control driver for the light source 42 may be within the cylindrical body (or housing) 40.

Figure 4:
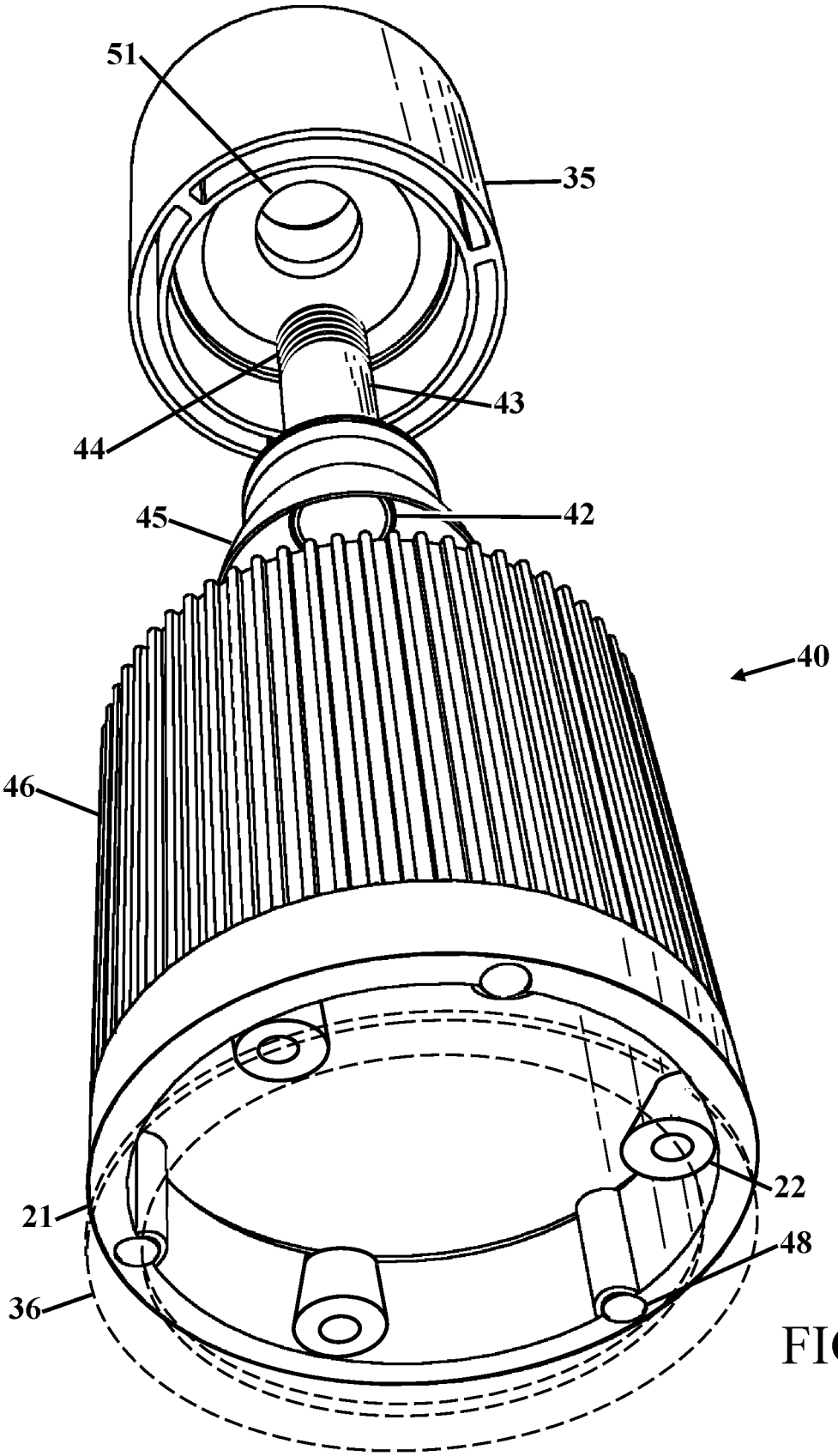
FIG. 4 shows an exploded perspective view of the lighting apparatus of FIG. 1.
Figure 5:
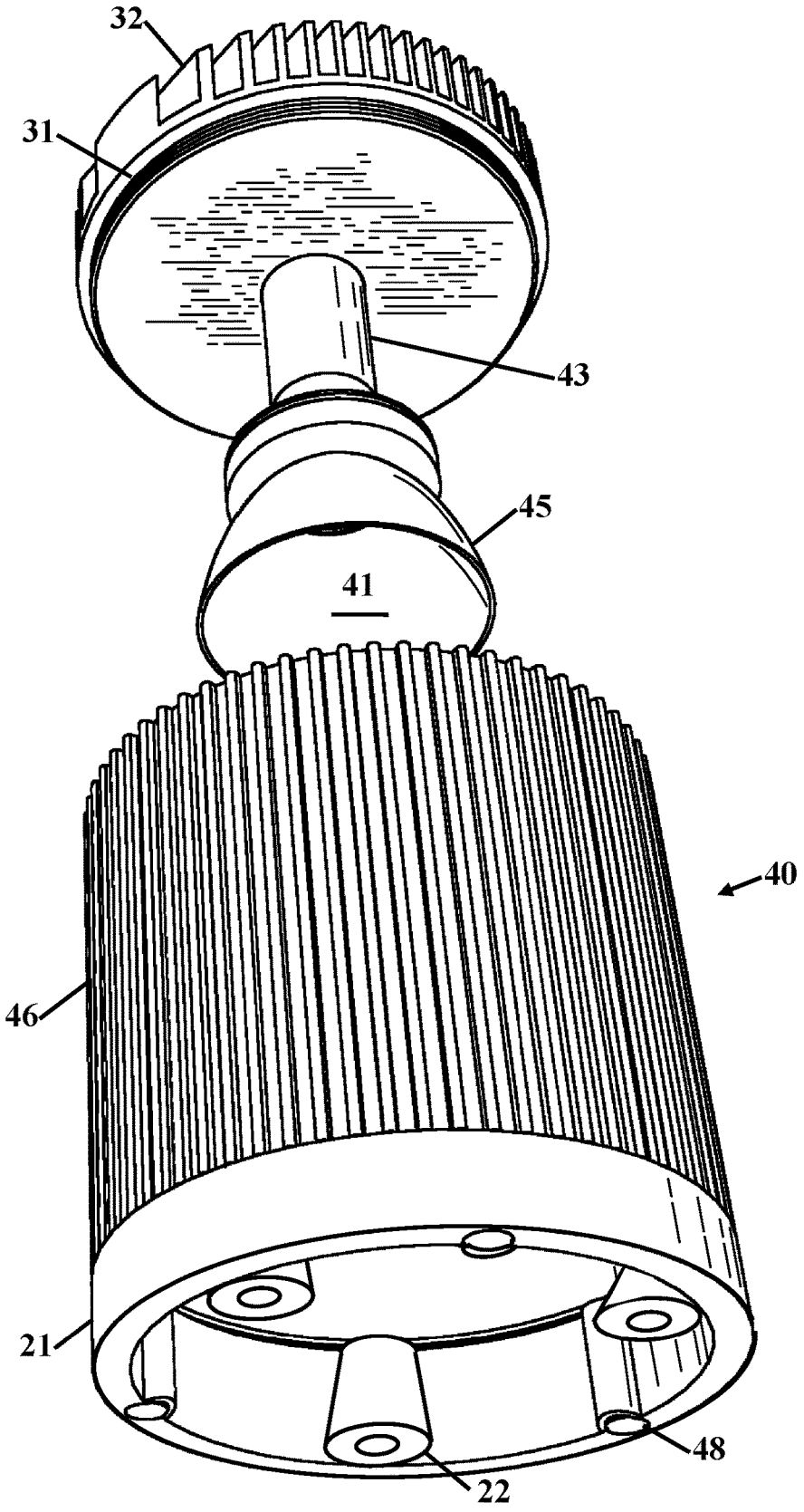
FIG. 5 shows an exploded perspective view of lighting elements of the lighting apparatus of FIG. 1.
Figure 6:
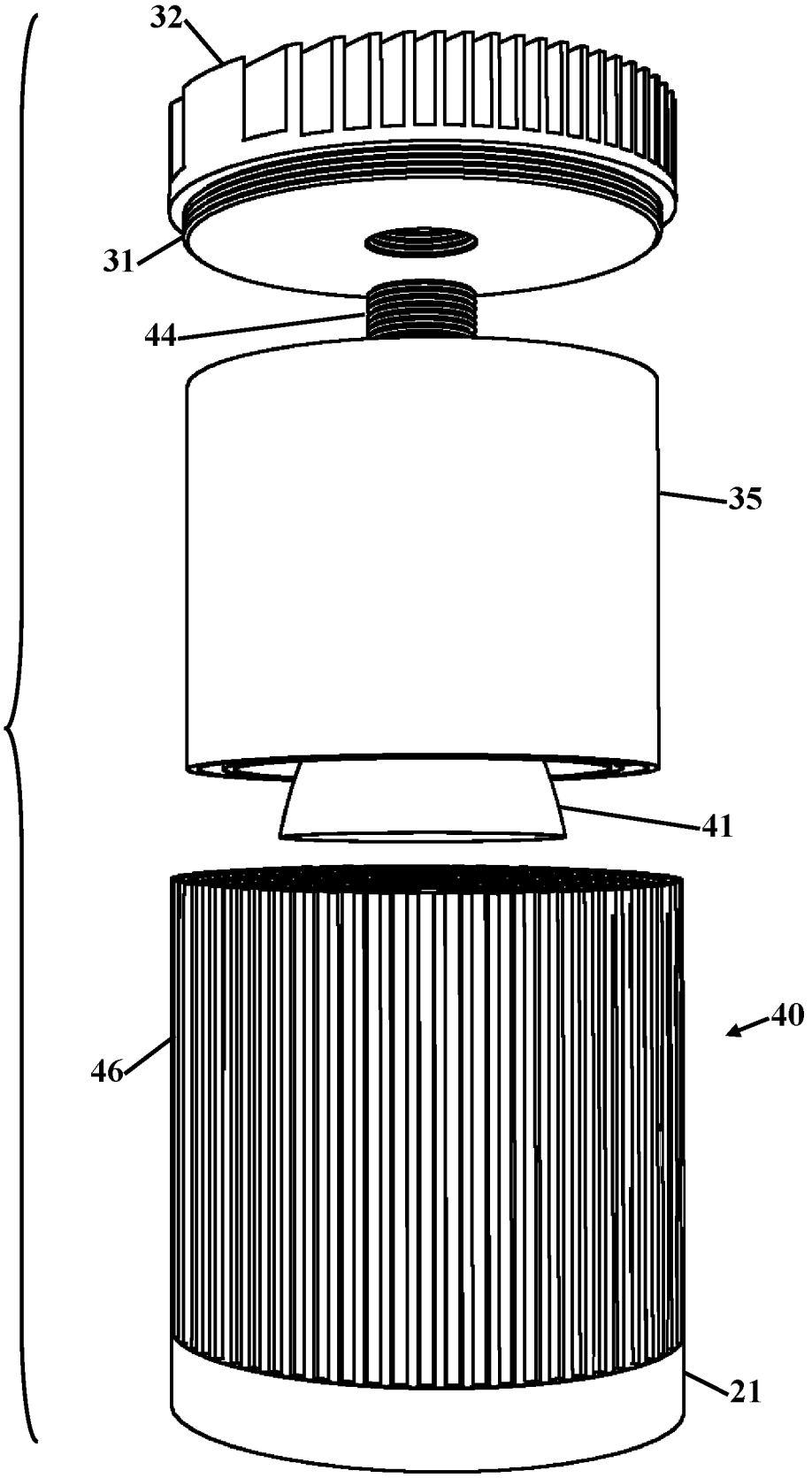
FIG. 6 shows an exploded perspective view of the lighting apparatus FIG. 1.

FIG. 4-FIG. 6 show exploded perspective views of different lighting elements and speaker elements according to one embodiment. In these figures, some elements have been removed for clarity. In FIG. 4, a woofer speaker enclosure 35 according to one embodiment is shown with a clearance hole 51 through the center of the woofer speaker. The clearance hole 51 may provide an opening for the heatsink transfer shaft 43 to pass through. In general, the woofer speaker may include a speaker cone (26, for example), a yoke, a magnet (49, for example), a front plate, a lower suspension, an upper surround, another suspension or surround (24, for example), and/or a voice coil of the woofer speaker, and the clearance hole 51 (and thus the heatsink transfer shaft 43) may pass through any one, more than one, or all such components of the woofer speaker. For example, in some embodiments, a magnet structure of the woofer speaker may include a back plate, a magnet, and a top plate, and the clearance hole 51 (and thus the heatsink transfer shaft 43) may pass through such a magnet structure.

A rear portion of the heatsink transfer shaft 43 may have threads 44 (at a threaded end, for example) that may thread into and affix the top cap/heatsink 32, but other securing mechanisms are contemplated. The threads 44 (or alternatives to the threads 44) may therefore detachably attach the light source 42 to the top cap/heatsink 32 and thus to the cylindrical body (or housing) 40 independently from attachment of one or more speakers to the housing. In general, in the embodiment shown and in other embodiments, one or more light sources (such as one or more LESs, for example) may be detachably attachable to the cylindrical body (or housing) 40 independently from attachment of one or more speakers to the housing.

The top cap/heatsink 32 may have a plurality of cooling fins that may absorb and disperse heat that is transferred through the heatsink transfer shaft 43. The outer surface of the top cap/heatsink 32 may include threads 31 that may connect the top cap/heatsink 32 to the cylindrical body 40. The cylindrical body 40 may also have integral ribs 46 or fins to provide additional surface area for cooling. The outer (lower) surface of the cylindrical body 40 may have an outer speaker ring 21, which may have one or more magnet fasteners 48 for securing a cosmetic grill covering (or cosmetic grill cover) 36 over the front of the lighting apparatus 19 to provide a cosmetic covering that may allow both light and sound to transfer through the cosmetic grill covering 36.

Referring back to the heatsink transfer shaft 43, the heatsink transfer shaft 43 may pass through the clearance hole 51, the speaker voice coil, and the woofer. The heatsink transfer shaft 43 may be attached and thermally connected to the light source 42 to transfer heat away from the light source 42. A reflector cone 41 may focus or direct light from the light source 42. The inside of the reflector cone 41 may be coated and may be shaped to provide desired light handling. The reflector cone 41 may be flared at a flare 45 to further spread and focus the light.

Figure 7:
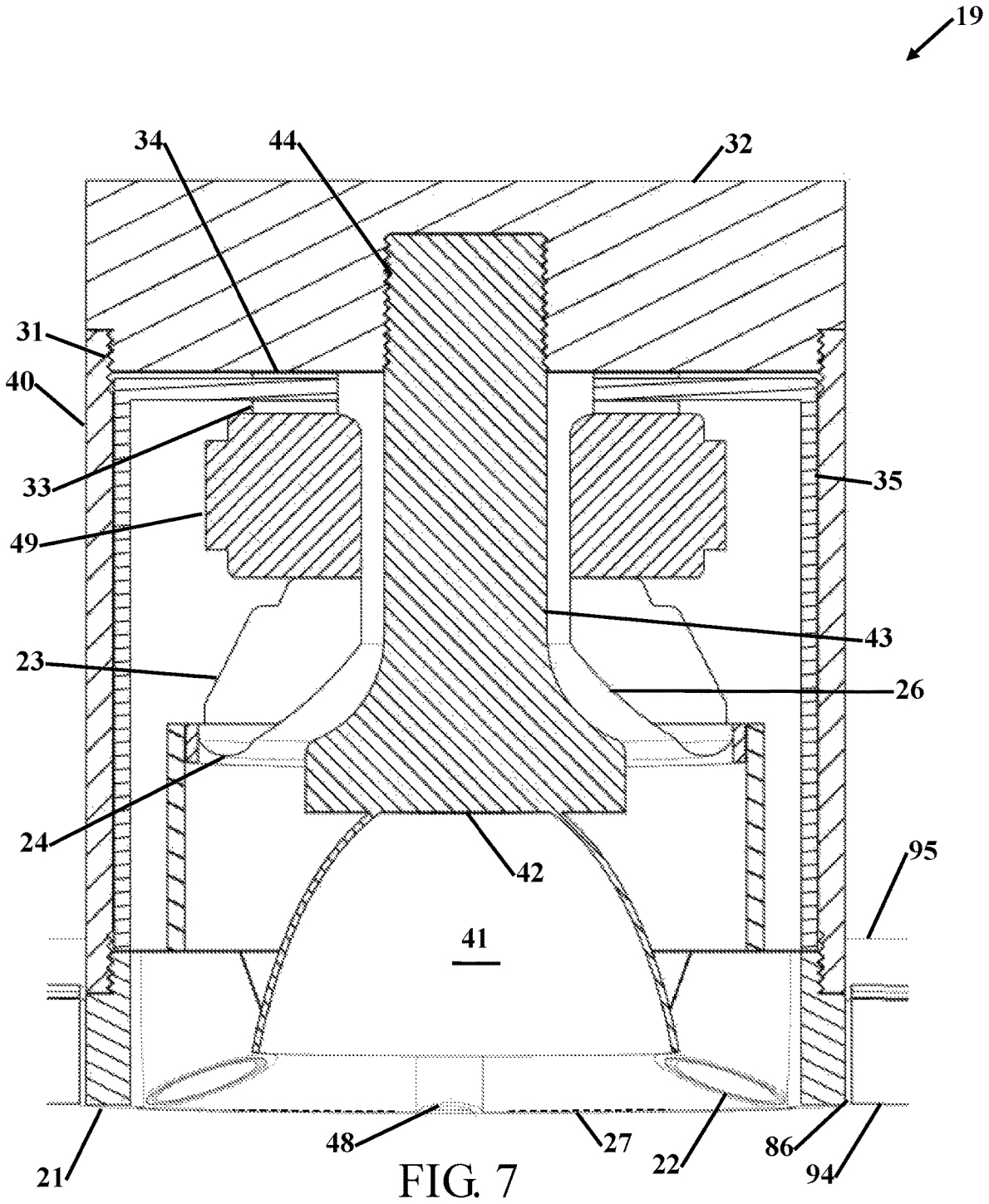
FIG. 7 is a cross-sectional view of the lighting apparatus FIG. 1.

FIG. 7 is a cross-sectional view of the lighting apparatus 19 when assembled according to one embodiment. In this figure, the lighting apparatus 19 is shown installed in a ceiling with the outer speaker ring 21 in a clearance hole 86 surrounded by drywall 94 or sheet rock with a portion of the mounting box front face 95 covered with the drywall 94. This is one possible orientation and configuration for the lighting apparatus 19 when installed. However, alternative embodiments may differ, and, for example, it is possible to install the lighting apparatus 19 in a horizontal configuration. In some embodiments, the lighting apparatus 19 may essentially be a cylindrical body that may thread together axially, but other securing mechanisms and shapes are also contemplated.

The light source 42 may be in the center of the lighting apparatus 19 within the reflector cone 41. The size and shape of the reflector cone 41 may be determined by an emitting angle of the light source 42 and by a desired light dispersion from the lighting apparatus 19. The rear of the light source 42 may be connected to the heatsink transfer shaft 43. The heatsink transfer shaft 43 may pass concentrically through the clearance hole 51 and the magnet 49 of the woofer 50.

Also, in the embodiment shown, the heat transfer shaft is a solid copper shaft or column, but alternative embodiments may differ. For example, the heat transfer shaft can be hollow or ribbed. Further, alternative embodiments may include one or more other light-source attachment bodies that may include one or more other heat conductors, and that may attach to a heatsink in other ways. For example, other embodiments may include one or more other materials and/or one or more other form factors, such as a heat pipe, for example. In some embodiments, a heat pipe may function as a heat-transfer device by combining both thermal conductivity and phase transition to transfer heat from a heat source (such as the light source 42 or one or more other light sources) to a heatsink (such as the top cap/heatsink 32 or one or more other heatsinks, for example). For example, in such embodiments, at the heat source, a liquid or gel in contact with a thermally conductive solid surface may turn into a vapor by absorbing heat from that surface, the vapor may then travel along the heat pipe to the heatsink and condense back into a liquid or gel, thereby releasing the latent heat, and the liquid or gel may then return to the heat source, for example by capillary action, centrifugal force, or gravity, and the cycle may repeat.

The heat transfer shaft 43 is shown threaded into the top cap heatsink 32. The outer lower edge of the top cap heatsink 32 has threads 31 that thread into the cylindrical body 40. The cylindrical body 40 is threaded at both ends, and at the lower end, the cylindrical body 40 is threaded into the outer speaker ring 21. Therefore, when the woofer speaker enclosure 35 is in the cylindrical body 40, and when the outer speaker ring 21 is threaded onto the lower end the cylindrical body 40, the outer speaker ring 21 may contact the woofer speaker enclosure 35 and detachably attach the woofer speaker to the cylindrical body 40. As a result, the woofer speaker enclosure 35 may more generally function as a speaker support body, and the outer speaker ring 21 may detachably attach the woofer speaker to the cylindrical body 40 by contacting the woofer speaker enclosure 35 (or an alternative speaker support body) as shown in FIG. 7, for example. The outer speaker ring 21 may more generally function as a speaker attachment body that may be movable relative to the cylindrical body 40 and that may detachably attach other speakers (such as the speakers 22, for example) to the cylindrical body 40. However, alternative embodiments may differ. For example, alternative embodiments may include one or more other speaker attachment bodies that may be movable relative to a housing and that may detachably attach one or more other speakers to the housing, for example by retaining a speaker support body in the housing. Alternative embodiments may also include alternatives to the threads as described herein.

A spacer cushion (or spacer or cushion) 34 may accommodate variation in manufacturing dimensions and may provide an air-tight seal between the cap heatsink 32 and the woofer speaker enclosure 35. The assembled components may sandwich the woofer speaker enclosure 35 within the lighting apparatus 19. However, as indicated above, alternative embodiments may differ and may, for example, include alternatives to the outer speaker ring 21.

The cross-section FIG. 7 shows the magnet 49 within the woofer speaker 50. The magnet and voice coil may move the woofer cone 26 that is supported on the woofer frame 23 by the circular surround suspension (or surround) 24. A spacer cushion (or spacer or cushion) 33 pads the rear of the woofer magnet 49. The woofer 50 is further suspended within the woofer speaker enclosure 35.

In the embodiment shown, the cylindrical body 40 and the top cap/heatsink 32 are solid, so that once the woofer speaker enclosure 35 and the light source 42 are positioned in the cylindrical body 40 and the outer speaker ring 21 is attached to the lower end the cylindrical body 40, the outer speaker ring 21 may essentially sandwich the woofer speaker and the light source 42 within the cylindrical body 40, and the woofer speaker may be totally enclosed or sealed within the cylindrical body 40. However, alternative embodiments may differ. For example, in some embodiments, the woofer speaker enclosure 35 and the cylindrical body 40 may define one or more openings, the top cap/heatsink 32 may define one or more openings, or both, such that the woofer speaker may be open to the mounting box 96, for example, and such that the woofer speaker may not necessarily be enclosed or sealed within the cylindrical body 40. In such embodiments, the mounting box 96 may be a speaker enclosure.

The outer speaker ring 21 may have features that may support one or a plurality of high-frequency mid-tweeter speakers 22. The mid-tweeters may be angled to project the higher frequency sound within the room. The outer speaker ring 21 may further have features, such as magnets 48 or other fasteners, to attract or secure a cosmetic facia 36. The outer speaker ring 21 may also have one or more microphone elements 27 to receive spoken word or other audio sounds or test signals from within a room in which the lighting apparatus 19 is located.

Figure 8:
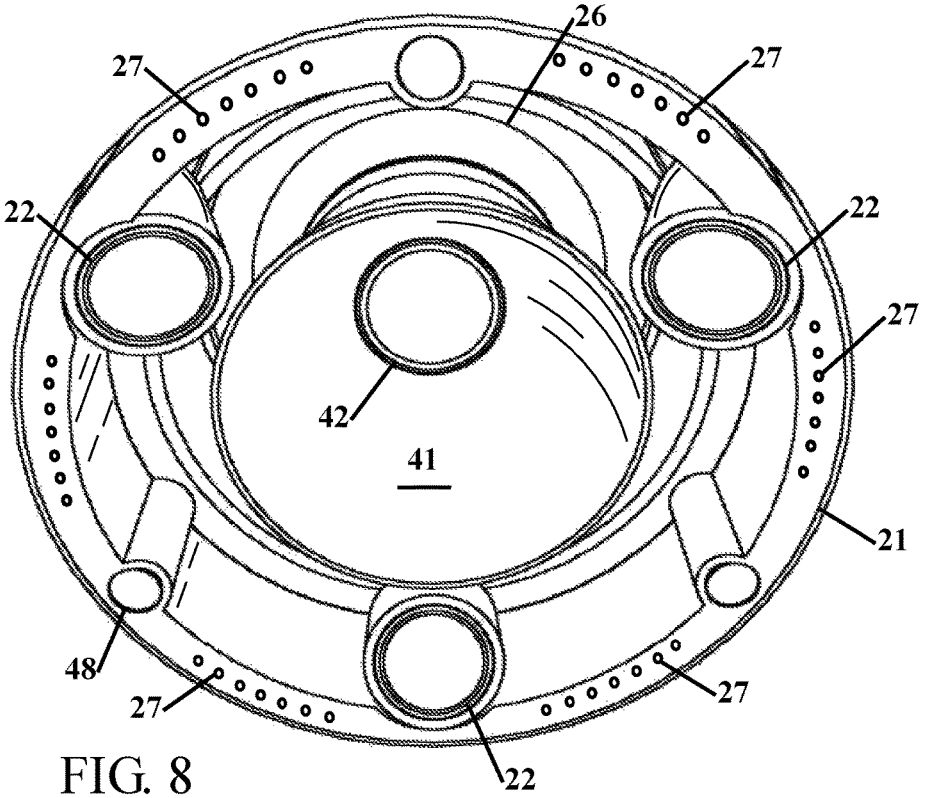
FIG. 8 is a perspective room view of the lighting apparatus FIG. 1 viewed from below without a cosmetic covering.

FIG. 8 is a perspective room view of the lighting apparatus 19 without cosmetic facia 36 installed. The outer speaker ring 21 is shown with three mid-high frequency speakers 22, although alternative embodiments may differ. Because higher frequency speakers may be more unidirectional, more than one high-frequency speaker may be used. The embodiment shown includes a plurality of openings for microphones 27 to allow one or a group of people to be heard using the lighting apparatus 19, for example. The light source 42 is shown in the center of the reflector cone 41, although alternative embodiments may differ. The reflector cone 41 may direct light outside of the lighting apparatus 19. A portion of the lower frequency woofer cone 26 is shown behind and around the reflecting cone 41, although alternative embodiments may differ. Lower-frequency sounds may be more omni-directional, so sounds from the woofer cone 26 may pass around the reflector cone 41 and spread within a room. The outer speaker ring 21 is shown with magnetic fasteners 48 that may provide attraction to a cosmetic outer covering that is shown and described in more detail in other figures and description herein, although alternative embodiments may differ.

Figure 9:
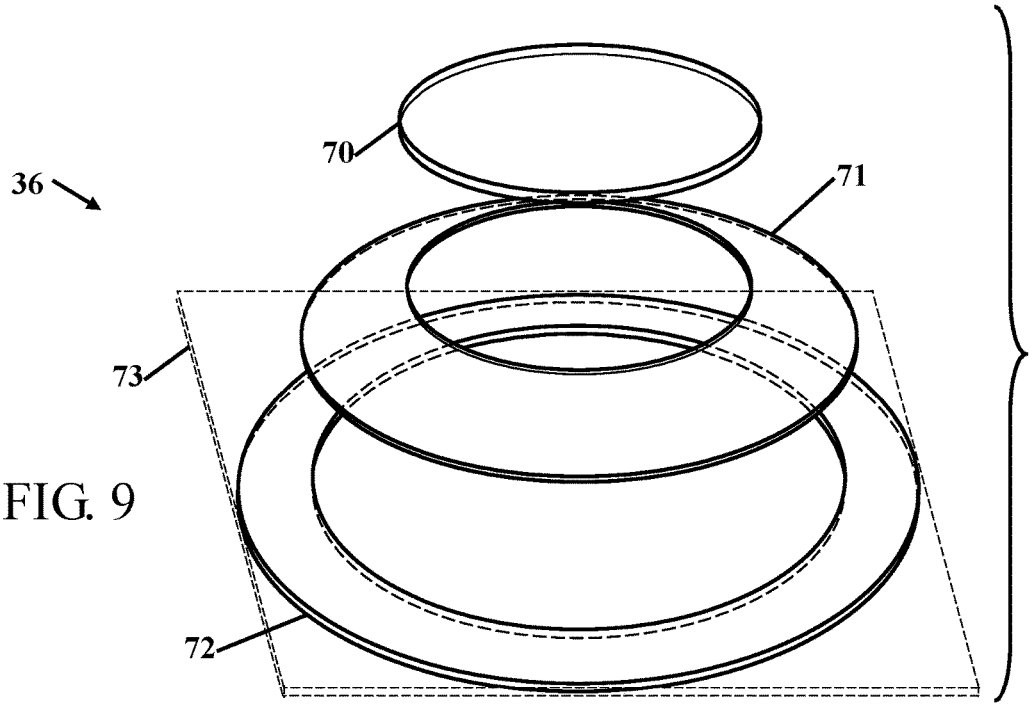
FIG. 9 is a perspective view of a cosmetic grill covering for the lighting apparatus FIG. 1 according to one embodiment.

FIG. 9 is a perspective view of the cosmetic facia 36 according to one embodiment. In the embodiment shown, a glass or plastic lens 70 covers the light source 42. A sound-transmissive lens spacer ring 71 allows sound to pass out of the lighting apparatus 19, and a cosmetic facia 72 surrounds the lens spacer ring 71, although alternative embodiments may differ. The shape of the cosmetic facia 72 in the embodiment shown is round, but may alternatively be in solid line and square 73, as shown in broken line. While these two shapes are shown other shapes are contemplated based upon the desired appearance. It is contemplated that the cosmetic facia 72 may be fabricated from a ferric material to allow the cosmetic facia covering to be secured to the lighting apparatus 19 with magnetic fasteners 48 for easy installation and removal, but other securing mechanisms are contemplated.

In some embodiments, the lighting apparatus 19 may be installed in a ceiling, wall, or other location with the light source 42 and with one or more speakers as described above. However, in other embodiments, the lighting apparatus 19 may be installed in a ceiling, wall, or other location with the light source 42 and without any speakers as described above. In such embodiments, after the lighting apparatus 19 is installed, the lighting apparatus 19 may be upgraded or otherwise modified to include one or more speakers as described above. Therefore, embodiments such as those described above may facilitate installing one or more speakers in a lighting apparatus that is already installed in a ceiling, wall, or other location.

Although specific embodiments have been described and illustrated, such embodiments should be considered illustrative only and not as limiting the invention as construed according to the accompanying claims.

The invention claimed is:

1. A method of modifying a lighting apparatus comprising a housing, at least one speaker, and at least one light source, the method comprising:

detachably attaching the at least one speaker to the housing when the at least one speaker is in the housing, and detachably attaching the at least one light source to the housing, wherein the at least one light source is detachably attachable to the housing independently from attachment of the at least one speaker to the housing.

2. The method of claim 1 wherein when the at least one light source and the at least one speaker are detachably attached to the housing, the at least one light source is connectable to a power source independent of a power source of the at least one speaker.

3. The method of claim 1 wherein the lighting apparatus further comprises a light-source attachment body, wherein a speaker of the at least one speaker comprises a magnet defining a through-opening, and wherein the at least one light source is detachably attachable to the housing by, at least, positioning the light-source attachment body through at least the through-opening of the magnet of the speaker, the light-source attachment body attached to the at least one light source.

4. The method of claim 3 wherein the light-source attachment body comprises a heat conductor thermally connected to the at least one light source.

5. The method of claim 4, wherein the lighting apparatus further comprises a heat sink; and wherein when the at least one light source and the at least one speaker are detachably attached to the housing, the at least one light source is on a first side of the speaker and is oriented to emit light from the first side of the speaker, and wherein the at least one speaker is oriented to emit sound from the first side of the speaker; and wherein the at least one light source is detachably attachable to the housing by, at least, detachably attaching the heat conductor to the heatsink on a second side of the speaker opposite the first side of the speaker, the heatsink comprising a plurality of cooling fins.

6. The method of claim 5, wherein the speaker further comprises a speaker cone and a voice coil, wherein:

the housing is a cylindrical body;

the at least one light source is light-emitting diode (LED) elements;

the light-source attachment body is a heatsink transfer shaft;

the heatsink is a heatsink cap on the housing; and the at least one light source is detachably attachable to the housing by, at least, positioning the heatsink transfer shaft through the speaker cone, the voice coil, and the magnet of the speaker.

7. The method of claim 1, wherein the lighting apparatus further comprises a speaker attachment body, and wherein detachably attaching the at least one speaker to the housing comprises detachably attaching the speaker attachment body to the housing, the speaker attachment body being movable relative to the speaker and to the housing.

8. The method of claim 7 wherein detachably attaching the speaker attachment body to the housing comprises threadedly attaching the speaker attachment body to the housing.

9. The method of claim 7, wherein the lighting apparatus further comprises a speaker support body, and wherein detachably attaching the speaker attachment body to the housing comprises retaining the speaker support body in the housing such that the speaker support body supports the speaker.

10. The method of claim 1 wherein detachably attaching the at least one speaker to the housing comprises detachably attaching the at least one speaker to the housing when the housing is mounted in a ceiling or wall.

11. A lighting apparatus comprising:

a housing;

at least one speaker positionable in the housing and detachably attachable to the housing when positioned in the housing; and at least one light source detachably attachable to the housing independently from attachment of the at least one speaker to the housing when the at least one speaker is positioned in the housing.

12. The apparatus of claim 11 wherein when the at least one light source and the at least one speaker are detachably attached to the housing, the at least one light source is connectable to a power source independent of a power source of the at least one speaker.

13. The apparatus of claim 11 wherein:

a speaker of the at least one speaker comprises a magnet defining a through-opening between a first side of the speaker and a second side of the speaker opposite the first side of the speaker; and the apparatus further comprises a light-source attachment body attached to the at least one light source, the light-source attachment body positionable through at least the through-opening of the magnet and detachably attachable to the housing such that detachably attaching the light-source attachment body to the housing detachably attaches the at least one light source to the housing when the at least one speaker is positioned in the housing.

14. The apparatus of claim 13 wherein the light-source attachment body comprises a heat conductor thermally connected to the at least one light source.

15. The apparatus of claim 14 wherein:

when the at least one light source and the at least one speaker are detachably attached to the housing, the at least one light source is on the first side of the speaker, the at least one light source is oriented to emit light from the first side of the speaker, and the at least one speaker is oriented to emit sound from the first side of the speaker;

the apparatus further comprises a heatsink comprising a plurality of cooling fins; and the light-source attachment body is positionable through at least the through-opening of the magnet and attachable to the heatsink such that detachably attaching the light-source attachment body to the heatsink detachably attaches the at least one light source to the housing when the at least one speaker is positioned in the housing.

16. The apparatus of claim 15 wherein:

the housing is a cylindrical body;

the at least one light source is light-emitting diode (LED) elements;

the light-source attachment body is a heatsink transfer shaft;

the heatsink is a heatsink cap on the housing;

the speaker further comprises a speaker cone and a voice coil; and the heatsink transfer shaft is positionable through at least the speaker cone, the voice coil, and the through-opening of the magnet and attachable to the heatsink such that detachably attaching the heatsink transfer shaft to the heatsink detachably attaches the at least one light source to the housing when the at least one speaker is positioned in the housing.

17. The apparatus of claim 11 further comprising a speaker attachment body movable relative to the speaker and to the housing and detachably attachable to the housing, wherein detachably attaching the speaker attachment body to the housing detachably attaches the at least one speaker to the housing when the at least one speaker is positioned in the housing.

18. The apparatus of claim 17 wherein the speaker attachment body is threadedly attachable to the housing.

19. The apparatus of claim 17 further comprising a speaker support body supporting the speaker, wherein detachably attaching the speaker attachment body to the housing detachably attaches the speaker support body in the housing.

20. A lighting apparatus comprising:

a housing;

at least one speaker positionable in the housing and comprising a means for detachably attaching the at least one speaker to the housing when the at least one speaker is positioned in the housing; and at least one light source comprising a means for detachably attaching the at least one light source to the housing independently from attachment of the at least one speaker to the housing when the at least one speaker is positioned in the housing.

* * * * *